US005767878A

United States Patent [19]

Murphy

[11] Patent Number: 5,767,878

[45] Date of Patent: Jun. 16, 1998

[54] PAGE-WIDE PIEZOELECTRIC INK JET PRINT ENGINE WITH CIRCUMFERENTIALLY POLED PIEZOELECTRIC MATERIAL

[75] Inventor: Richard D. Murphy, Houston, Tex.

[73] Assignee: Compaq Computer Corporation, Houston, Tex.

[21] Appl. No.: 315,840

[22] Filed: Sep. 30, 1994

[51] Int. Cl.[6] ..... B41J 2/045

[52] U.S. Cl. ..... 347/71; 347/68; 347/72

[58] Field of Search ..... 347/71, 68, 69, 347/42; 310/357, 359

[56] References Cited

U.S. PATENT DOCUMENTS

| | | | |
|---|---|---|---|
| 4,536,097 | 8/1985 | Nilsson | 400/126 |
| 4,879,568 | 11/1989 | Bartky | 346/140 |
| 4,887,100 | 12/1989 | Michaelis et al. | 346/140 |
| 5,016,028 | 5/1991 | Temple | 346/140 |
| 5,227,813 | 7/1993 | Pies et al. | 346/140 |
| 5,235,352 | 8/1993 | Pies et al. | 347/71 |
| 5,365,645 | 11/1994 | Walker et al. | 29/25.35 |
| 5,373,314 | 12/1994 | Everett et al. | 347/71 |
| 5,400,064 | 3/1995 | Pies et al. | 347/71 |

FOREIGN PATENT DOCUMENTS

| | | | |
|---|---|---|---|
| 0486256A2 | 5/1992 | European Pat. Off. | B41J 2/015 |
| 9319940 | 10/1993 | European Pat. Off. | B41J 2/045 |
| 0615845A2 | 9/1994 | European Pat. Off. | B41J 2/155 |
| 55-83274 | 6/1980 | Japan | 310/359 |
| 6143575 | 5/1994 | Japan | B41J 2/045 |
| 2 098 134 | 5/1981 | United Kingdom | B41J 3/04 |

*Primary Examiner*—Mark J. Reinhart
*Assistant Examiner*—Charlene Dickens
*Attorney, Agent, or Firm*—Vinson & Elkins L.L.P.

[57] ABSTRACT

A page wide piezoelectric ink jet print engine and a method of manufacturing the same. The page wide ink jet print engine includes lower and upper body parts, each formed from piezoelectric material and having a plurality of generally parallel, spaced projections. Lower side surfaces of the projections of the lower body part are conductively mounted to corresponding bottom side surfaces of the projections of the upper body part to define a plurality of generally parallel, axially extending ink-carrying channels from which ink may be ejected. The lower and upper body parts are then circumferentially poled such that, for the lower body part, first and second polarization fields respectively extend between the top side surface of each one of the projections and top side surfaces of first and second projections adjacent thereto and, for the upper body part first and second polarization fields respectively extend between the bottom side surface of each one of the projections and bottom side surfaces of first and second projections adjacent thereto. By applying voltage to selective ones of the projections, the channels may be selectively expanded to draw ink from an associated ink delivery system and compressed to cause the ejection of a droplet of ink therefrom.

18 Claims, 4 Drawing Sheets

FIG. 4
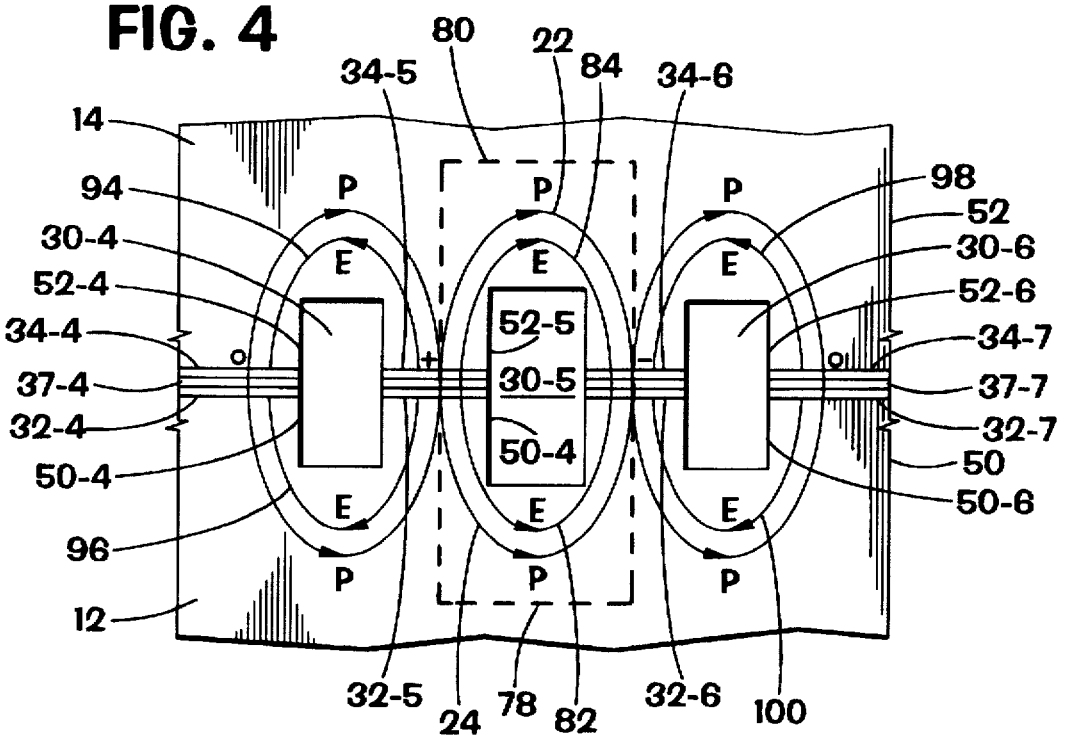
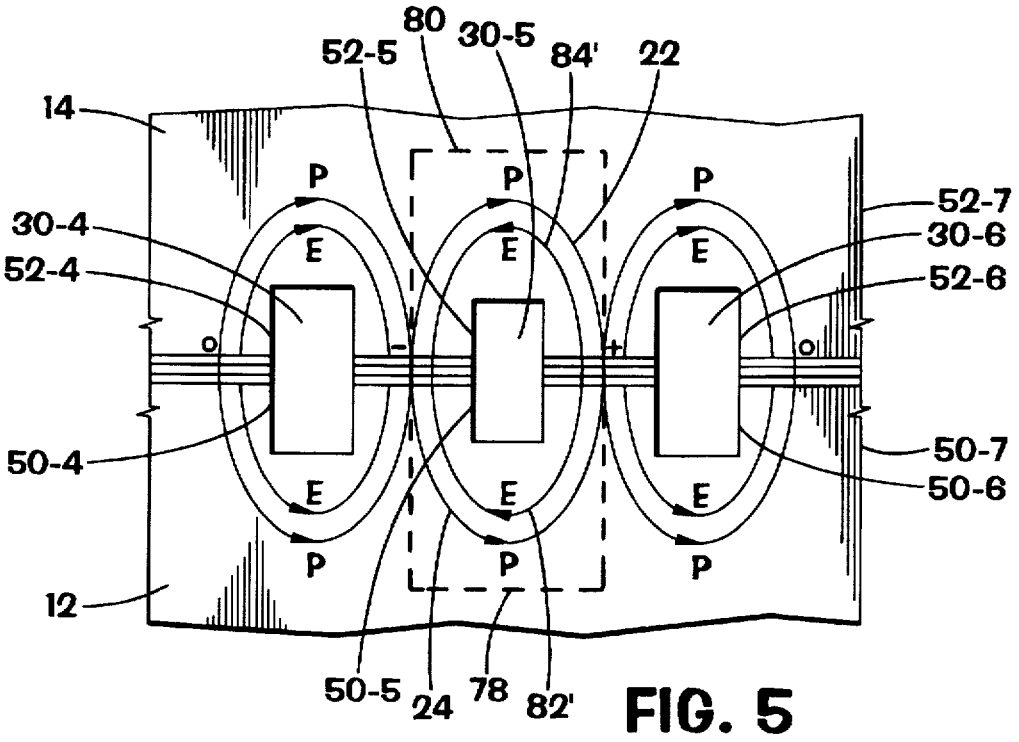
FIG. 5

PAGE-WIDE PIEZOELECTRIC INK JET PRINT ENGINE WITH CIRCUMFERENTIALLY POLED PIEZOELECTRIC MATERIAL

BACKGROUND OF THE INVENTION

1. Field of the Invention

The invention relates to a page wide piezoelectric ink jet print engine and, more particularly, to a page wide piezoelectric ink jet print engine having circumferentially actuators for firing ink-carrying channels axially extending therethrough.

2. Description of Related Art

Ink jet printing systems use the ejection of tiny droplets of ink to produce an image. The devices produce highly reproducible and controllable droplets, so that a droplet may be printed at a location specified by digitally stored image data. Most ink jet printing systems commercially available may be generally classified as either a "continuous jet" type ink jet printing system where droplets are continuously ejected from the printhead and either directed to or away from the paper depending on the desired image to be produced or as a "drop-on-demand" type ink jet printing system where droplets are ejected from the printhead in response to a specific command related to the image to be produced.

In drop-on-demand type ink jet printing systems, transient pressures in the fluid are induced by the application of a voltage pulse to a piezoelectric material which is directly or indirectly coupled to the fluid. These transient pressures cause pressure/velocity transients to occur in the fluid and these are directed so as to produce a droplet that issues from an orifice. Recently, considerable interest has been directed to piezoelectric drop-on-demand type ink jet printheads which utilize sidewall actuators to impart droplet ejecting pressure pulses into the ink carrying channels. See, for example, U.S. Pat. Nos. 4,536,097 to Nilsson, 4,879,568 to Bartky et al., 4,887,100 to Michaelis et al. and 5,016,028 to Temple. Bartky et al., Michaelis et al. and Temple further disclose shear mode sidewall actuators characterized by the fact that the poling direction extends normal to the widthwise direction of the page.

In U.S. Pat. Nos. 5,227,813 and 5,235,352, both to Pies et al., both I-field and U-field type drop-on-demand ink jet printheads were disclosed. The I-field type ink jet printhead includes a lower body portion formed from an inactive material, a plurality of intermediate sections formed from an active piezoelectric material and an upper body portion formed from an inactive material. The lower body portion further included an upper side surface and a plurality of generally parallel spaced projections vertically projecting therefrom. Lower side surfaces of a plurality of intermediate sections were conductively mounted to top side surfaces of the lower body projections and the upper body portion was conductively mounted to upper side surfaces of the plurality of intermediate sections. In this manner, an ink jet printhead in which the lower body portion, the plurality of intermediate sections and the upper body portion defined a plurality of generally parallel, longitudinally extending ink ejecting channels was formed. For this ink jet printhead, the intermediate sections further defined first and second actuators for each of the channels. As the electric field applied to each of the first and second actuators to cause the deflection thereof extends between the top and bottom side surfaces, the aforementioned printhead is commonly referred to as an I-field type printhead.

Except for the use of a lower body portion formed from an active piezoelectric material, the U-field type ink jet printhead is constructed in a manner identical to that described in connection with the I-field type ink jet printhead. This distinction, however, provides significant operational benefits to the U-field type ink jet printhead. Instead of the intermediate sections providing only first and second actuators for each of the channels, for the U type ink jet printhead, the intermediate sections provide first and second actuators while the projections and the part of the lower body portion between the projections provide a third actuator for each of the channels. As the electric field which causes the deflection of the third actuator extends between the juncture of the lower and intermediate sections on opposite sides of a channel, this printhead is commonly referred to as a U-field type printhead.

In U.S. patent application Ser. No. 07/859,671, filed Mar. 30, 1992, a UU-field (or double U-field) type drop-on-demand ink jet printhead was disclosed. The double U-field type ink jet printhead included lower and upper body portions formed from an active piezoelectric material. The lower body portion further included an upper side surface and a plurality of generally parallel spaced projections vertically projecting therefrom and the upper body portion includes a lower side surface and a plurality of generally parallel space projections projecting vertically therefrom. Top side surfaces of the lower body projections were then conductively mounted to bottom side surfaces of the upper body projections to form a plurality of generally parallel, longitudinally extending channels from which ink may be ejected therefrom. In this manner, an ink jet printhead in which the lower body projections and the part of the lower body portion between the lower body projections define a first actuator and the upper body projections and the part of the upper body portion between the upper body projections define a second actuator for each of the channels is formed. As both of the electric fields which cause the deflection of the first and second actuators extend between the juncture of the lower and upper sections on opposite sides of a channel, this printhead is commonly referred to as a double U-field type printhead.

All of these printhead configurations utilized sections of piezoelectric material that would have electrodes formed thereon for poling purposes and then are poled in a single transverse direction relative to the channel direction. The poling electrodes are then removed and the piezoelectric material re-electroded for shear mode actuation. For example, U.S. patent application Ser. No. 08/149,717, filed Nov. 9, 1993 discloses a method of manufacturing a U-field type ink jet printhead where the side surfaces of an unpoled base piece and unpoled thin piece of piezoelectric material are electroded and a voltage applied thereacross to respectively pole the base and thin pieces. Once poled, these electrodes are stripped off and first and second layers of conductive material deposited on the top side surface of the base piece and the bottom side surface of the thin piece, respectively, to enable shear mode excitation. The first and second layers of conductive material are conductively mounted to each other and a series of sidewalls produced by forming parallel grooves which extend through the thin piece and part of the base piece, for example, using a sawing process.

One drawback to such a method of manufacture is that the sawing process used to form parallel grooves in the poled piezoelectric material tends to damage the poling fields present in the base and thin pieces adjacent to the sawed surfaces. The surface layer becomes an increasingly larger fraction of the wall width as resolution of the printhead increases. In contrast, by poling after completion of the sawing step, damage to the poling field resulting from the sawing step is eliminated. Another drawback to such a method of manufacture is that the technique is only suitable for manufacturing ink jet printhead having a relatively narrow widthwise dimension and cannot be readily applied to the manufacture of page-wide arrays.

More specifically, the aforementioned base and thin pieces were poled in the widthwise direction, i.e. the direction generally parallel to the width of the page. Typically, to properly pole piezoelectric material requires a voltage differential on the order of 30 to 75 volts per mil, i.e., per one-thousandth of an inch. Accordingly, to pole a one inch wide piece would require a voltage differential somewhere in the range of 30,000 and 75,000 volts. This poling voltage requirement has resulted in limiting the manufacturable width of an ink jet printhead body to about two inches since an appreciably wider piezoelectric body section would require an unacceptably higher poling voltage. For example, an eight and one-half inch (or "page") wide piezoelectric printhead would require a poling voltage somewhere in the range of 255,000 and 637,500 volts. Even if this much wider PZT body section could be properly poled at this extremely high voltage, the material would tend to crack during or upon completion of the poling process for the PZT body section.

This PZT printhead body width limitation has resulted in the inability to manufacture piezoelectric ink jet printheads in full page, i.e. eight and one-half inch, widths. This necessitates the shuttling back and forth of a relatively small width, i.e., one inch, piezoelectric printhead across a print medium sheet interiorly traversing the ink jet printer. While acceptable for many uses, such small width or "shuttle-type" ink jet printheads are generally characterized by slower print speeds and complicated mechanical drive systems. Accordingly, shuttle-type devices are generally considered less desirable than page-wide devices. As a result, it has been further contemplated that several such printheads be physically attached to each other to form a page-wide device. U.S. patent application Ser. No. 08/034,743, filed Mar. 19, 1993 discloses a method by which plural two inch wide blocks of piezoelectric material are stitched together to form a single page-wide array. However, the difficulties associated with stitching several blocks of piezoelectric material into a single page-wide array adds considerable cost to the manufacture of such a device. Furthermore, such techniques raise some concerns as to the uniformity of channels which extend across the boundary between two pieces of stitched piezoelectric material.

U.K. Patent Publication GB 2 098 134 discloses a printing device in which rounded grooves are formed in an unpoled piece of piezoelectric material. The top and bottom and side surfaces of the grooved piece are then plated with a layer of conductive material and a voltage applied thereacross to pole the piezoelectric material. As the interior surfaces of the grooves are plated and the poling field is applied between the top and bottom side surfaces thereof, a radially poled piece of piezoelectric material is produced. One shortcoming to such a device is that the, upon application of a voltage thereto, the sidewalls separating adjoining channels will distort in a manner which decreases the volume of both adjoining channels. As a result, rather than firing adjoining channels sequentially, such a device will tend to cause adjoining channels to fire simultaneously.

Thus, it is desired to provide a page-wide piezoelectric ink jet print engine having individually actuatable ink-carrying channels. It is further desired to provide a method of manufacturing such a page-wide piezoelectric print engine from page-wide blocks of piezoelectric material. Accordingly, it is an object of the present invention to provide such a printhead and associated method of manufacture.

SUMMARY OF THE INVENTION

In one embodiment, the present invention is of an ink jet print engine comprised of a generally U-shaped lower body part having first and second top side surfaces and a generally U-shaped upper body part having first and second bottom side surfaces conductively mounted to the first and second top side surfaces of the lower body part to define an elongated liquid confining channel. Also provided are means for generating, between the first and second top side surfaces, contour-extensional deformation of the lower body part. In one aspect thereof, means for generating, between the first and second bottom side surfaces, contour-extensional deformation of the upper body part are also provided.

In further aspects thereof, the lower body part is constructed of piezoelectric material circumferentially poled between the first and second top side surfaces and the upper body part is constructed of piezoelectric material circumferentially poled between the first and second bottom side surfaces. Controller means for selectively applying a voltage differential between the first and second top side surfaces and between the first and second bottom side surfaces may be further provided. By forming first and second strips of conductive material on the first and second top side surfaces, respectively, and by longitudinally extending the lower body part to expose a portion of the first and second strips of conductive material, electrical interconnection surfaces for driving the ink jet print engine are provided.

In another embodiment, the present invention is of a page wide ink jet print engine which includes lower and upper body parts formed from unpoled piezoelectric material. The lower body part is comprised of a base section and a plurality of generally parallel, spaced projections extending longitudinally along the base section and upwardly therefrom and the upper body part is comprised of a top section and a corresponding plurality of generally parallel spaced projections extending longitudinally along the top section and downwardly therefrom. Each of the projections of the lower body part has a top side surface conductively mounted to a bottom side surface of a corresponding projection of the upper body part to define a plurality of generally parallel, axially extending ink-carrying channels from which ink may be ejected. The lower body part is then circumferentially poled such that first and second polarization fields respectively extend between the top side surface of each one of the projections and top side surfaces of first and second projections adjacent thereto and the upper body part is circumferentially poled such that first and second polarization fields respectively extend between the top side surface of each one of the projections and top side surfaces of first and second projections adjacent thereto. Each of the ink-carrying channels is defined by a pair of adjacent lower body projections, a segment of the bottom section between the pair of adjacent lower body projections, a corresponding pair of adjacent upper body projections and a segment of the top section between the pair of adjacent upper body projections.

In further aspects thereof, conductive strips are respectively formed on the top and bottom side surfaces of each one of the lower and upper body projections and a layer of conductive adhesive provided to conductively mounting the conductive strips. A controller having a control lead electrically connected to the conductive strip formed on the top side surface of each one of the lower body projections and configured to selectively impart either a positive, a zero, or a negative voltage to each of the conductive strips may be further provided. In yet another aspect thereof, the lower body part is dimensionally larger than the upper body part along a longitudinal axis thereof such that the conductive strip formed on the top side surface of each one of the lower body projections is exposed along a portion of the lower body part to provide electrical interconnection surfaces for the ink jet print engine.

In another embodiment, the present invention is of a method of manufacturing a page wide ink jet print engine. Lower and upper body portions, both formed from an unpoled piezoelectric material are provided. A plurality of generally parallel grooves which extend from a top side surface of the lower body portion and through part of the lower body portion are formed, thereby producing a plurality of generally parallel lower sidewall parts which longitudinally extend inwardly from the front side surface. Similarly, a plurality of generally parallel grooves which extend from a bottom side surface of the upper body portion and through part of the upper body portion are formed, thereby producing a plurality of generally parallel upper sidewall parts which longitudinally extend inwardly from the front side surface. A top side surface of each of the lower sidewall parts is conductively mounted to a bottom side surface of a corresponding upper sidewall part to form a plurality of channels, each having a first sidewall defined by a first lower sidewall part and a first upper sidewall part and a second sidewall defined by a second lower sidewall part and a second upper sidewall part. The lower body portion is then circumferentially poled such that, for each of the ink-carrying channels, a first polarization field which extends from the top side surface of the first lower sidewall part to the top side surface of the second lower sidewall part is formed. In one aspect, the upper body portion is also circumferentially poled such that, for each of the ink-carrying channels, a second polarization field which extends from the bottom side surface of the first upper sidewall part to the bottom side surface of the second upper sidewall part is formed.

In yet another embodiment, the present invention is a method of manufacturing a page wide ink jet print engine. A layer of conductive material is deposited on a top side surface of a lower body portion formed from an unpoled piezoelectric material. A plurality of generally parallel grooves which extend through the layer of conductive material and part of the lower body portion are formed, thereby producing a plurality of generally parallel lower sidewall parts, each having a strip of conductive material formed on a top side surface thereof, which longitudinally extend inwardly from the front side surface. An upper body portion which is shorter, along a longitudinal axis, than the lower body portion and formed from an unpoled piezoelectric material is provided and a plurality of generally parallel grooves which extend from a bottom side surface of the upper body portion and through a part of the upper body portion are formed, thereby producing a plurality of generally parallel upper sidewall parts which longitudinally extend inwardly from the front side surface. Front side surfaces of the lower and upper body portions are aligned such that a portion of the conductive strips are exposed along a rear part of the lower body portion. A bottom side surface of each of the upper sidewall parts is conductively mounted to the conductive strip formed on the top side surface of a corresponding one of the lower sidewall parts to produce a plurality of channels, each having a first sidewall defined by a first lower sidewall part and a first upper sidewall part and a second sidewall defined by a second lower sidewall part and a second upper sidewall part. The lower and upper body portions are then circumferentially poled.

In one aspect thereof, the lower and upper body portions are circumferentially poled by alternately connecting the exposed portion of every other one of the conductive strips to either a positive side or a negative side of a poling power supply and applying a voltage having a selected magnitude to the conductive strips. Once poled, the exposed portions of the conductive strips may be disconnected from the power source and each one of the exposed portion of the conductive strips electrically connected to a control lead of a controller configured to selectively apply a positive, zero or negative voltage to the control lead.

BRIEF DESCRIPTION OF THE DRAWINGS

The present invention may be better understood, and its numerous objects, features and advantages will become apparent to those skilled in the art by reference to the accompanying drawing, in which:

FIG. 4 is a first, reduced size, schematically illustrated partial front view of the channel array of FIG. 2 taken during a fill segment of the droplet ejection process;

FIG. 5 is a second, reduced size, schematically illustrated, partial front view of the channel array of FIG. 2 taken during a jet segment of the droplet ejection process.

DETAILED DESCRIPTION

Figure 1:
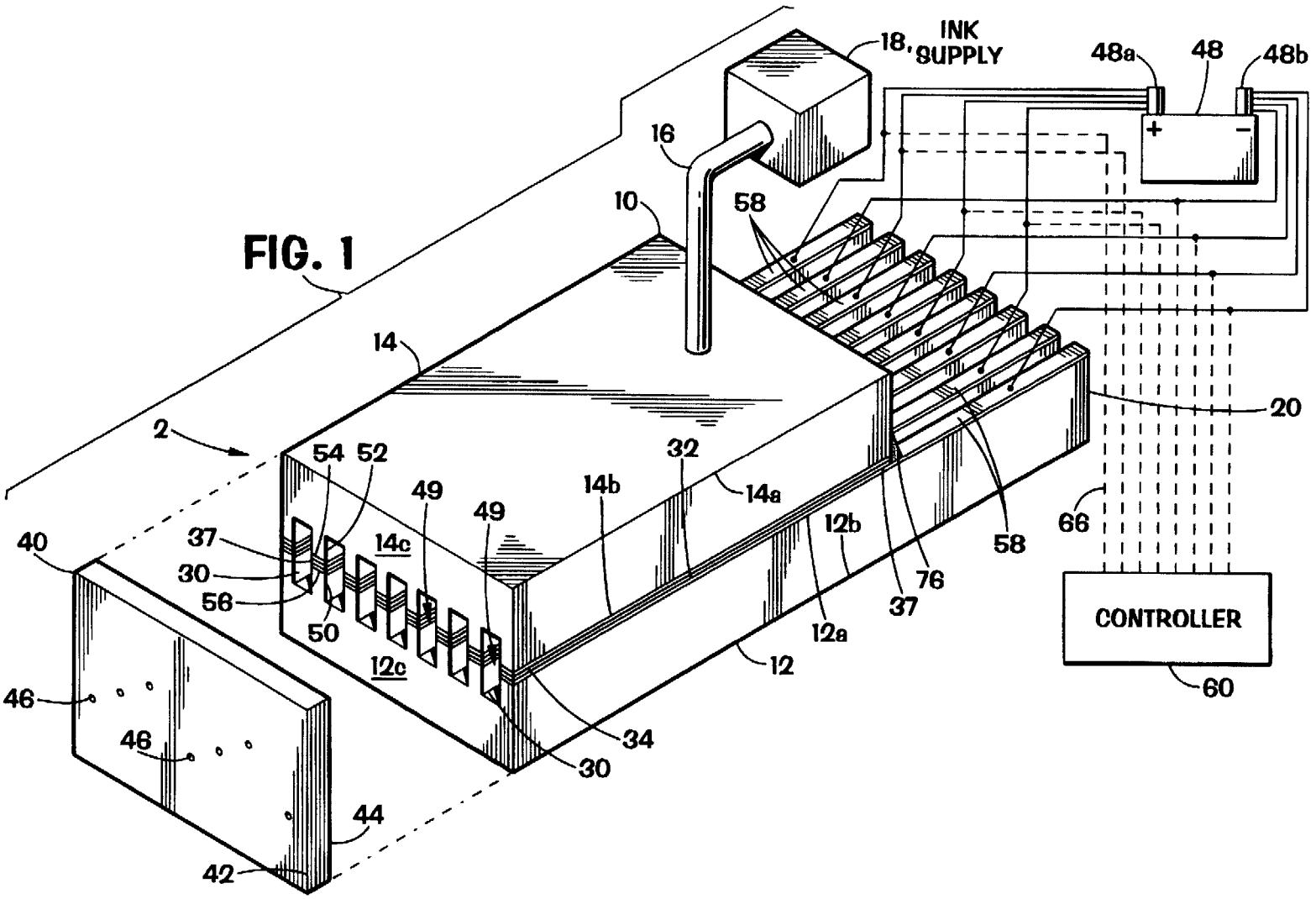
FIG. 1 is a perspective view of a page wide drop-on-demand ink jet print engine constructed in accordance with the teachings of the present invention.

Referring now to the drawing wherein thicknesses and other dimensions have been exaggerated in the various figures as deemed necessary for explanatory purposes and wherein like reference numerals designate the same or similar elements throughout the several views, in FIG. 1, an page wide, piezoelectric ink jet print engine 2 constructed in accordance with the teachings of the present invention may now be seen. The print engine 2 includes a page wide, piezoelectric channel array 10 constructed of lower and upper body parts 12 and 14, each having respective top and bottom side surfaces **12*a*, 12*b* and 14*a*, 14*b*. Formed onto the top side surface 12*a* of the lower body part 12 and the bottom side surface 14*b* of the upper body part 14, respectively, are metallized conductive surfaces 32 and 34 which will be more fully described later. A plurality of laterally extending grooves of predetermined width and depth are respectively formed through the lower body part 32 and the upper body part 34 such that, when the two parts are joined together in the manner herein described, a plurality of pressure chambers or ink-carrying channels 30 are formed, thereby producing a channel array 10** for the ink jet print engine 2. It should be noted, however, that while the grooves and ink-carrying channels 30 are illustrated as being generally rectangular in shape, it should be clearly understood that it is specifically contemplated that the grooves and ink-carrying channels 30 may be formed in other, non-rectangular, shapes. For example, it is contemplated that grooves and channels having rounded contours will be suitable for the uses contemplated herein.

Prior to joining the lower and upper body parts 12 and 14, a manifold (not visible) in communication with the channels 30 is formed near the rear portion of the ink jet printhead 10. Preferably, the manifold is comprised of a channel (also not visible) extending through the upper body part 14 in a direction generally perpendicular to the channels 30. As to be more fully described below, the manifold communicates with an external ink conduit 16 to provide means for supplying ink to the channels from a source of ink 18 connected to the external ink conduit 16.

To form the ink jet printhead illustrated in FIG. 1, first and second generally rectangular blocks formed from an unpoled piezoelectric material are required to produce the lower and upper body parts 12 and 14. To form one such block, powdered piezoelectric material is pressed into the desired generally rectangular shape. Preferably, the height and width of the blocks should be similarly dimensioned while the block used to form the lower body part 12 should have a greater lengthwise dimension. Once pressed into the desired shape, the piezoelectric material is then fired and the surfaces smoothed by conventional grinding techniques to form the desired generally rectangular blocks of unpoled piezoelectric material. Preferably, one of the several lead zirconate titante (or "PZT") formulations is used for the piezoelectric material selected to form the blocks of unpoled piezoelectric material. It should be clearly understood, however, that other, comparable, piezoelectric materials could be used to manufacture the ink jet print engine disclosed herein without departing from the scope of the present invention.

After the lower and upper body parts 12 and 14 are formed, the upper surface 12*a* of lower body part 12 and the lower surface 14*b* of the upper body part 14 are metallized to form respective metallized conductive surfaces 32, 34. In the preferred embodiment, the metallization process would be accomplished by depositing a layer of a nichrome-gold alloy on each of the surfaces 12*a* and 14*b*. It should be clearly understood, however, that the aforementioned deposition process is but one manner in which a layer of conductive material may be applied to the surfaces 12*a*, 14*b* and that numerous other conductive materials and/or processes would be suitable for use herein.

Next, a machining process is then commenced to form the aforementioned series of grooves in each of the upper and lower body parts 12 and 14. Starting at the metallized conductive surface 32 deposited on the upper surface 12*a* of the lower body part 12 and the metallized conductive surface 34 deposited on the lower surface 14*b* of the upper body part 14, respectively, corresponding series of axially extending, substantially parallel grooves which extend across the entire length of the lower and upper body parts 12 and 14, respectively, in a direction generally perpendicular to the respective front side surfaces 12*c*, 14*c* of the lower and upper body parts 12 and 14, are formed. The grooves should extend downwardly through the metallized conductive surfaces 32, 34, respectively, and partially through the lower and upper body parts 12 and 14, respectively, and be formed in a manner so that the grooves of the lower and upper body parts 12, 14 are alignable during mating.

Next, a layer 37 of conductive adhesive such as epoxy or other suitable conductive adhesive is applied to the remaining portions of the metallized conductive surface 32 of the lower body part 12 and the remaining portions of the metallized conductive surface 32 are conductively mounted to the remaining portions of the metallized conductive surface 34 of the upper body part 14. Typically, the layer 37 of conductive adhesive would be kept very thin, most likely on the order of about two tenths to one-half of a mil in thickness and would be applied to the remaining portions of the metallized conductive surface 32, thereby forming a series of strip-shaped sections of conductive adhesive. The grooves formed in the lower and upper body parts 12 and 14 may then be coated with a thin layer of a dielectric material and then mated and bonded together, for example, by using flip-chip bonding equipment such as that manufactured by Research Devices. Alternately, the conductive bonding between the remaining portions of the metallized conductive surface 32 of the lower body part 12 and the metallized conductive surface 34 of the upper body part 14 may be achieved by soldering the metallized conductive surfaces 32, 34 to each other, thereby eliminating the need for a conductive adhesive.

It is contemplated that, in accordance with one embodiment of the invention, the metallized conductive surfaces 32, 34 may be eliminated entirely while maintaining satisfactory operation of the page wide, ink jet print engine 2, so long as the surface 14*b* of the upper body part 14 and the surface 12*a* of the lower body part 12 are conductively mounted together and a voltage may be readily applied to the layer 37 of conductive adhesive provided therebetween. Thus, in one embodiment of the invention, it is contemplated that a single layer 37 of conductive adhesive is applied to the remaining portions of the top side surface 12*a* of the lower body part 12 to conductively mount the surfaces 12*a* and 14*b* to each other. It should be noted, however, that the use of solder would not be available for use when the metallized conductive surfaces 12, 14 have been eliminated.

In an alternate aspect thereof, the grooves of the lower and upper body parts 12, 14 may be formed simultaneously to improve the alignability thereof. More specifically, a single block of unpoled piezoelectric material having the same height and width dimensions but having a length dimension generally equal to the combined lengths of the lower and upper body parts 12, 14 is formed and a layer of conductive material is deposited on an upper side surface thereof, for example, using the aforementioned metal deposition process. A series of axially extending, substantially parallel grooves which extend across the entire length of the unpoled block of piezoelectric material in a direction generally perpendicular to a front side surface thereof, are formed. The grooves should extend downwardly through the metallized conductive surfaces and partially through the unpoled block of piezoelectric material. The block of unpoled piezoelectric material is then divided into lower and upper body parts 12 and 14, each having the desired length, by cutting the single block into two pieces. The lower and upper body parts 12 and 14 may then be mounted together in the aforementioned manner.

By forming a series of generally parallel grooves in the lower and upper body parts 12 and 14, a plurality of lower and upper sidewall parts 50 and 52 are produced. Furthermore, as the grooves extend through the layers of conductive materials 32, 34, respectively formed on the top side surface 12*a* of the lower body part 12 and the bottom side surface 14*b* of the upper body part 14, a strip 54 of conductive material remains on the top side surface of each of the lower sidewall parts 50 and a strip 56 of conductive material remains on the bottom side surface of each of the upper sidewall parts 52. Finally, as the lower body part 12 is longer than the upper body part 14, when the two are mounted together, a portion 58 of the conductive strips formed on the top side surface of each of the lower sidewall parts 50 are exposed. This extension of the lower body part 12 where portions 58 of the conductive strips 54 are exposed, generally referred to as "back porch" 20 of the page wide, piezoelectric print engine 2, provides a readily accessible location for electrically interconnecting the conductive strips with a power source.

By mounting the lower and upper body parts 12 and 14 to each other in accordance with any one of the suitable techniques disclosed herein, a series of channels 30 which form the channel array 10 for the present invention of a page wide, piezoelectric ink jet print engine 2 have been formed. Each channel 30 is bounded by a first sidewall 49 comprised of a first lower sidewall part 50 and a first upper sidewall part 52, a second sidewall 49 comprised of a second lower sidewall part 50 and a second upper sidewall part 52, and portions of the lower and upper body parts 12 and 14 which separate the first and second sidewalls 49. It should be noted that, for ease of illustration, the page wide channel array 10 is illustrated as being comprised of channels 30-1 through 30-7. It is contemplated, however, that 300 or more channels may be formed for every inch that the page wide channel array 10 extends in the widthwise direction. Accordingly, it is contemplated that a page wide channel array constructed in accordance with the methods disclosed herein may include 2,550 or more channels 30.

The page wide channel array 10 remains unpoled and is, therefore, unable to be distorted by the application of a voltage differential thereto to effect the ejection of droplets of ink from one or more channels thereof. Accordingly, upon mounting the lower and upper body parts 12 and 14 together, the page wide channel array 10 should then be poled. To circumferentially pole the channel array 10, alternating ones of the strips 50 are commonly connected to positive and negative terminals **48*a* and 48*b* of a direct current (or "D.C.") power supply 48 such as a battery. For example, starting from the visible side of the channel array 10, the portions 58 of the odd-numbered conductive strips 50 may be commonly connected to the negative terminal 48*b* of the DC power supply 48 while the portions 58 of the even-numbered conductive strips 50 are commonly connected to the positive terminal 48*a* of the DC power supply 48. The DC power supply 48 is then raised to an appropriately high voltage level and maintained at that level for a period of time sufficiently long to complete circumferential poling of the page wide channel array 10. For example, it is contemplated that an appropriate voltage level for application to the page wide channel array 10 is 1,000 volts. This voltage compares quite favorably with the 255,000 to 637,500 volts required to pole a similar page wide piece of piezoelectric material in a single direction in accordance with the teachings of the prior art. Thus, a similar polarization of a page wide piece of piezoelectric material was achieved using a substantially lower voltage. Furthermore, internal stresses produced during the poling process are confined to the vicinity of the channels and fall off towards the interior of the part. Thus, the undesirable cracking of the piezoelectric material resulting from the poling of page wide pieces in accordance with the teachings of the prior art have been avoided. After circumferentially poling the lower and upper body parts 12 and 14, the portions 58 of the conductive strips 50 are disconnected from the power supply 48 and individually connected to a control lead of a controller 60** configured to selectively apply a positive, rest or negative voltage, for example, +1, 0 or −1 volt, to each control lead.

Figure 2:
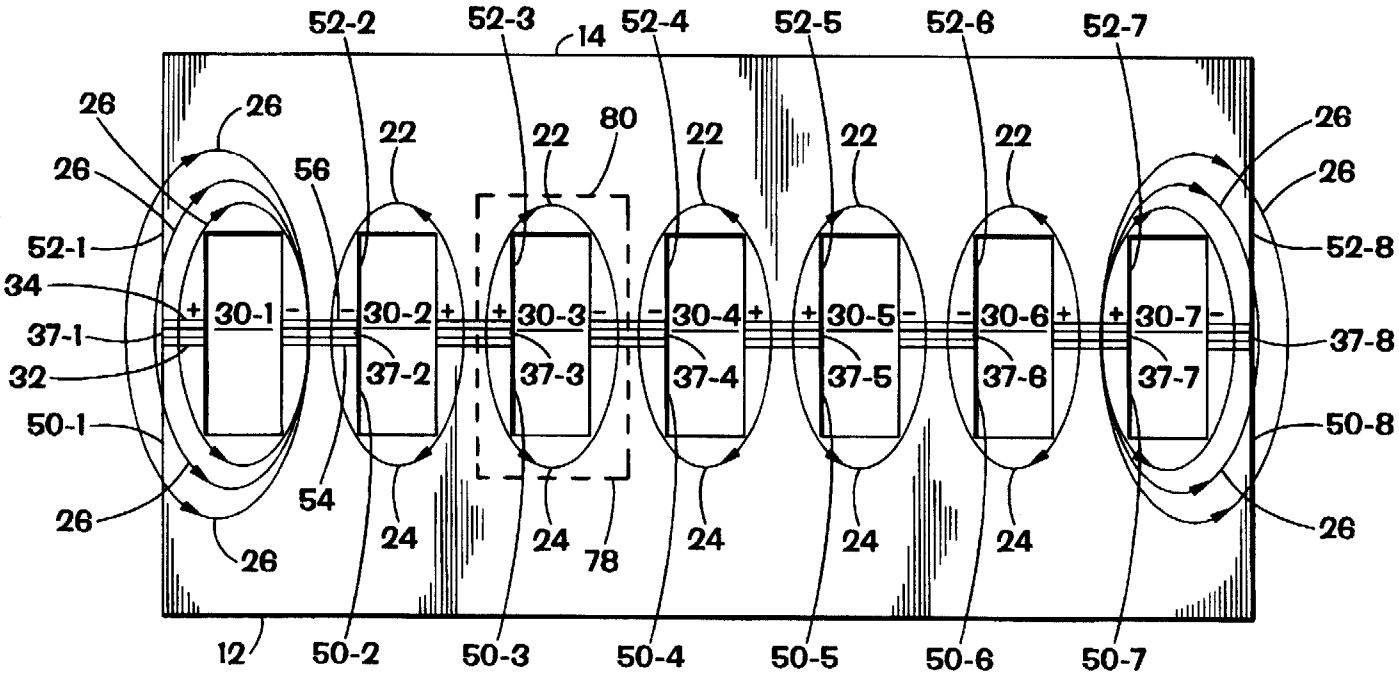
FIG. 2 is a schematically illustrated front view of a page wide, circumferentially poled piezoelectric channel array portion of the ink jet print engine of FIG. 1.

Referring now to FIGS. 1 and 2, the polarization fields 22, 24 produced by applying a 1,000 volt differential between sidewalls 49 on opposite sides of each channel 30-1 through 30-7 may now be seen. Specifically, for each channel 30, the polarization field 22 extends from the strip 37 of conductive adhesive located between the lower and upper sidewall parts 50 and 52 of a first sidewall 49, through the upper sidewall part 52 of the first sidewall 49, a portion of the upper body part 14 which separates the first and second sidewalls 49 which define a channel 30, the upper sidewall part 52 of a second sidewall 49 and to the strip 37 of conductive adhesive located between the lower and upper sidewall parts 50 and 52 of the second sidewall 49. Similarly, the polarization field 24 extends from the strip 37 of conductive adhesive located between the lower and upper sidewall parts 50 and 52 of the first sidewall 49, through the lower sidewall part 50 of the first sidewall 49, a portion of the lower body part 12 which separates the first and second sidewalls 49 which define a channel 30, the lower sidewall part 50 of a second sidewall 49 and to the strip 37 of conductive adhesive located between the lower and upper sidewall parts 50 and 52 of the second sidewall 49. The direction of the polarization fields 22, 24 extend from the strip 37 of conductive adhesive held to a positive voltage to the strip 37 of conductive adhesive held to a negative voltage.

As may be seen in FIG. 2, alternating ones of the polarization fields 22 of the upper body part 14 are mirror symmetrical with each other and will, therefore, be characterized by very similar distortions in response to the application of an electric field thereto. Alternating ones of the polarization fields 24 of the lower body part 12 are mirror symmetrical as well. Finally, the polarization fields 22 and 24 which respectively extend through the portions of the upper and lower body parts 14, 12 which define a single channel 30 are in the same direction. Thus, by selective application of a voltage differential of a given magnitude between the conductive strips 37 of the first and second sidewalls 49 which define the channels 30, each one of the channels 30 may be similarly driven, i.e., caused to eject, at a desired velocity, a droplet of ink having a desired volume. Asymmetrical polarization fields 26 will be produced in the portions of the lower and upper body parts 12 and 14 which define the end channels 30-1 and 30-7 of the page wide channel array 30. As a result, the characteristics of a droplet of ink ejected therefrom would differ from droplets ejected from channels 30 defined by symmetrically circumferentially polarized portions of the lower and upper body parts. Accordingly, it is recommended that at least one, and possibly two channels 30, on each end of the page wide channel array 10 are left inactive after poling, i.e. remain unconnected to the controller 60.

Continuing to refer to FIG. 2, a page wide channel array 10 comprised of a plurality of channels 30-1, 30-2, 30-3, 30-4, 30-5, 30-6 and 30-7, each of which axially extends through the ink jet print engine 2 and is actuatable by first and second U-shaped actuators, will now be described in greater detail. As may be seen here, the grooves formed in the lower and upper body parts 12, 14 form a series of lower body projections 50-1, 50-2, 50-3, 50-4, 50-5, 50-6, 50-7 and 50-8 and upper body projections 52-1, 52-2, 52-3, 52-4, 52-5, 52-6, 52-7 and 52-8 which are then bonded together by a strip-shaped section 37-1, 37-2, 37-3, 37-4, 37-5, 37-6, 37-7 and 37-8 of the layer 37 of conductive material to form the channels of the channel array. For example, the channel 30-3 is defined by a first sidewall formed by the combination of the projection 50-2, the strip-shaped section 37-2 and the projection 52-2, a section of the upper body part 14, a second sidewall formed by the combination of the projection 50-3, the strip-shaped section 37-3 and the projection 52-3 and a section of the lower body part 12.

By forming the channels of a parallel channel array in the manner herein described, an ink jet printhead in which each channel is actuatable by a pair of generally U-shaped actuators, the first U-field actuator being formed by the portion of the lower body part 12 which defines the channel and the second U-field actuator being formed by the portion of the upper body part 14 which defines the same channel, is produced. For example, the channel 30-3 is actuatable by a first generally U-shaped actuator 78 and a second generally U-shaped actuator 80.

Returning momentarily to FIG. 1, the page wide, piezoelectric ink jet print engine 2 further includes a front wall 40 having a front side 42, a back side 44 and a plurality of tapered orifices 46 extending therethrough. The back side 44 of the front wall 40 is aligned, mated and bonded with the upper and low body portions 12, 14 such that each orifice 46 is in communication with a corresponding one of the plurality of channels 30 formed by the joining of the upper and lower body portions 12, 14, thereby providing ink ejection nozzles for the channels. Preferably, each orifice 46 should be positioned such that it is located at the center of the end of the corresponding channel 30. It should be clearly understood, however, that the ends of each of the channels 30 could function as orifices for the ejection of drops of ink in the printing process without the necessity of providing the front wall 40 and the orifices 46.

The channels are actuated by a controller 60 such as a microprocessor or other integrated circuit which supplies a voltage signal to various ones of the sidewalls 49 via a corresponding control line 66 shown in phantom in FIG. 1. Each control line 66 is connected to one of the sidewalls 49 so that a desired voltage pattern to be more fully described below may be imparted to the first and second sidewalls 49 for each channel 30 of the page wide ink jet print engine 2 to selectively eject a droplet of ink therefrom. Briefly, the controller 60 operates the page wide ink jet print engine 2 by transmitting a series of positive and/or negative voltages to selected ones of the portions 58 of the conductive strips 50. In turn, the voltage supplied to the conductive strips 50 will cause the first and second U-shaped actuators 78 and 80 which forms the axially extending walls of a channel 30 to deform in a certain direction such that a droplet of ink will be forcibly ejected therefrom.

Thus, by selectively placing selected voltages on the conductive strips 50 which separate the first and second U-shaped actuators 78 and 80 for a channel 30, the channel may be selectively "fired", i.e., caused to eject ink, in a given pattern, thereby producing a desired image. Finally, it should be noted that, while, in the embodiment of the invention disclosed herein, the controller 60 is illustrated as being positioned at a remote location, it is contemplated that, in various alternate embodiments, the controller 60 may be mounted on a rearward extension of the lower body part 12 or on the top or side of the fully assembled page wide, piezoelectric ink jet print engine 2.

Finally, since the grooves formed in the lower and upper body parts 12 and 14 extend the entire length thereof, a piece 76 formed of a composite material, blocks a rear end portion of the channels 30 formed by the mating of the lower and upper body parts 12 and 14 so that ink supplied to the channels 30 shall, upon actuation of a selected channel 30, be propagated in the forward direction where it exits the page wide ink jet print engine 2 through the orifice 46 in communication with the selected channel 30.

To activate the page wide ink jet print engine 2 by selectively firing one or more of the channels 30-2 through 30-6, the controller 60 responds to an input image signal representative of an image desired to be printed and applies voltages of predetermined magnitude and polarity to certain ones of the conductive strips 50-2 through 50-7, thereby creating electric fields which will deflect the sidewalls of those channels 30-2 through 30-7 which must be fired in order to produce the desired image.

Figure 3:
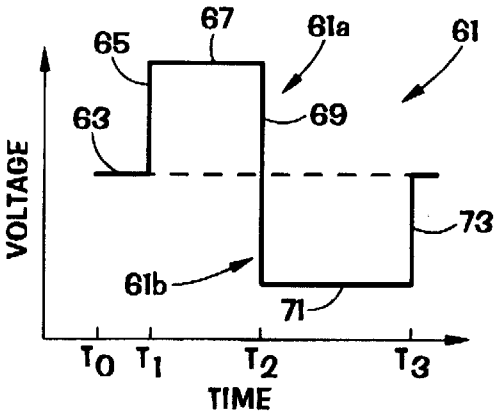
FIG. 3 is a graphical illustration of a voltage waveform which is applied to a selected channel of the channel array of FIG. 2 to cause the ejection of a droplet of ink therefrom.

Referring next to FIGS. 3–5, the firing of a single channel 30, for example, the channel 30-5, of the page wide ink jet print engine 2 will now be described in greater detail. Prior to firing, the channel 30-5, like all of the channels 30-1 through 30-7, are filled with ink received from the ink supply 18 via an ink delivery system, which includes the external ink conduit 16, the internal ink conduit (not shown) and the ink manifold (also not shown), coupled to rear end portions of the channels 30. By selective application of voltage under the control of the controller 60 and, in a manner subsequently described in greater detail, the portions of the lower and upper body parts 12 and 14 which defines the channels 30 selected for activation undergo respective first, expansive, contour-extensional deformations which expand the volume of the selected channels 30 to draw additional ink into the channels 30 from the ink delivery system. The portions of the lower and upper body parts 12 which define the channels 30 selected for actuation then undergo respective second, contractive, contour-extensional deformations which reduce the volume of the selected channels 30, thereby forcibly ejecting a droplet of ink outwardly through the orifice 46 associated with the selected channels 30.

FIG. 3 illustrates a voltage waveform 61 to be applied to the conductive strip 32 formed on the top side surface of the lower sidewall part 50 of a first sidewall 49 which partially defines a channel 30 selected for actuation. While not illustrated, a voltage waveform of equal duration but opposite magnitude is simultaneously applied to the conductive strip 32 formed on the top side surface of the lower sidewall part of a second sidewall 49 for the selected channel 30. For example, if the channel 30-5 is selected for activation, the voltage waveform 61 illustrated in FIG. 3 is applied to the conductive strip 32-5 while the reverse voltage waveform is applied to the conductive strip 32-6.

The voltage waveform 61 includes first and second portions 61*a*, 61*b* which cause the ejection of a droplet of ink from the selected channel 30 of the page wide jet print engine 2. From a rest state 63, during which a rest state voltage is applied to the conductive strip 32-5, and the actuator remains in a rest position, the voltage waveform 63 begins a first rapid rise 65 at time $T_1$ to a first or peak voltage to be applied to the conductive strip 32-5. Simultaneously therewith, the voltage applied to the conductive strip 32-6 would undergo a rapid fall of equal magnitude from the rest voltage. The voltage waveform 63 enters a first dwell state 67 which extends from time $T_1$ to time $T_2$. In this manner, a voltage differential is produced between the conductive strips 32-5 and 32-6. As the lower and upper body parts 12 and 14 are circumferentially poled, the electric fields 82 and 84 produced by the application of a voltage differential between the conductive strips 32-5 and 32-6 extend along the poling directions 24 and 22, respectively, thereby producing expansive contour-extensional deformations of the first U-shaped actuator portion 78 of the lower body part 12 and of the second U-shaped actuator portion 80 of the upper body part 14 which cause the volume of the channel 30-5 to increase. During the first dwell state 57, the voltage is held constant at the first value to maintain the expanded volume of the channel 30-5, thereby creating a fill cycle which draws ink out of the ink delivery system and into the channel 30-5.

Next, at time $T_2$, the voltage waveform 61 begins a rapid fall 69 during which the voltage drops below the rest voltage (thereby ending the first portion 61*a* and beginning the second portion 61*b* of the voltage waveform 61) to a second, lower value. During the fall 69, the voltage applied to the conductive strip 32-5 drops to the second value (while the voltage applied to the conductive strip 32-6 rises to the first value). As the electric fields 82' and 84' produced by the application of a voltage differential between the conductive strips 32-5 and 32-6 still extend along the poling directions 24 and 22, respectively, the first and second U-shaped actuator portion 78 and 80 again undergo contour-extensional deformation. However, as the direction of the electric fields 82' and 84' are now reversed, a contractive contour-extensional deformation of the U-shaped actuator portions 78 and 80 which causes a reduction of the volume of the channel 30-5 and the ejection of a droplet of ink therefrom occurs.

Once reaching the second, lower value, the voltage waveform 61 enters a second dwell state 71 which extends from time $T_2$ to time $T_3$. During this state, the voltage is held constant at the second value to maintain the compression of the channel 30-5. As the channels must be compressed from an expanded volume, past the rest volume, and to a compressed volume during the jet cycle, it is contemplated that the jet cycle which extends from time $T_2$ to time $T_3$ may be longer than the fill cycle which extends from time $T_1$ to time $T_2$.

At time $T_3$, the voltage waveform 61 will begin a second rapid rise 73 which will return the voltage waveform 61 to the rest state 63, thereby ending the secondary portion 61*b* of the voltage waveform 61 and return the channel to its original volume. Having returned to the rest state, the voltage waveform 61 remains at this state until the ejection of a next droplet of ink is initiated.

It should be noted that, by applying the aforementioned positive and negative polarity voltages to the conductive strips 32-5 and 32-6, electric fields 94, 96 which cause the channel 30-4 to expand are produced between the conductive strips 32-5 and 32-4 and electric field 98, 100 which cause the channel 30-6 to contract are produced between the conductive strips 30-7 and 30-6. However, as the conductive strips 32-4 and 32-7 are held to the rest voltage, the expansion and contraction of the channel 30-4 and 30-6 will be considerably less than that of the channel 30-5. Furthermore, it is specifically contemplated that the positive and negative voltage peaks will be selected such that the voltage differential between the peak voltage and the rest voltage will produce a pressure pulse insufficient to overcome the surface tension of the meniscus of the ink at the orifice 46, thereby preventing the ejection of ink from an unactuated channel.

Figure 6:
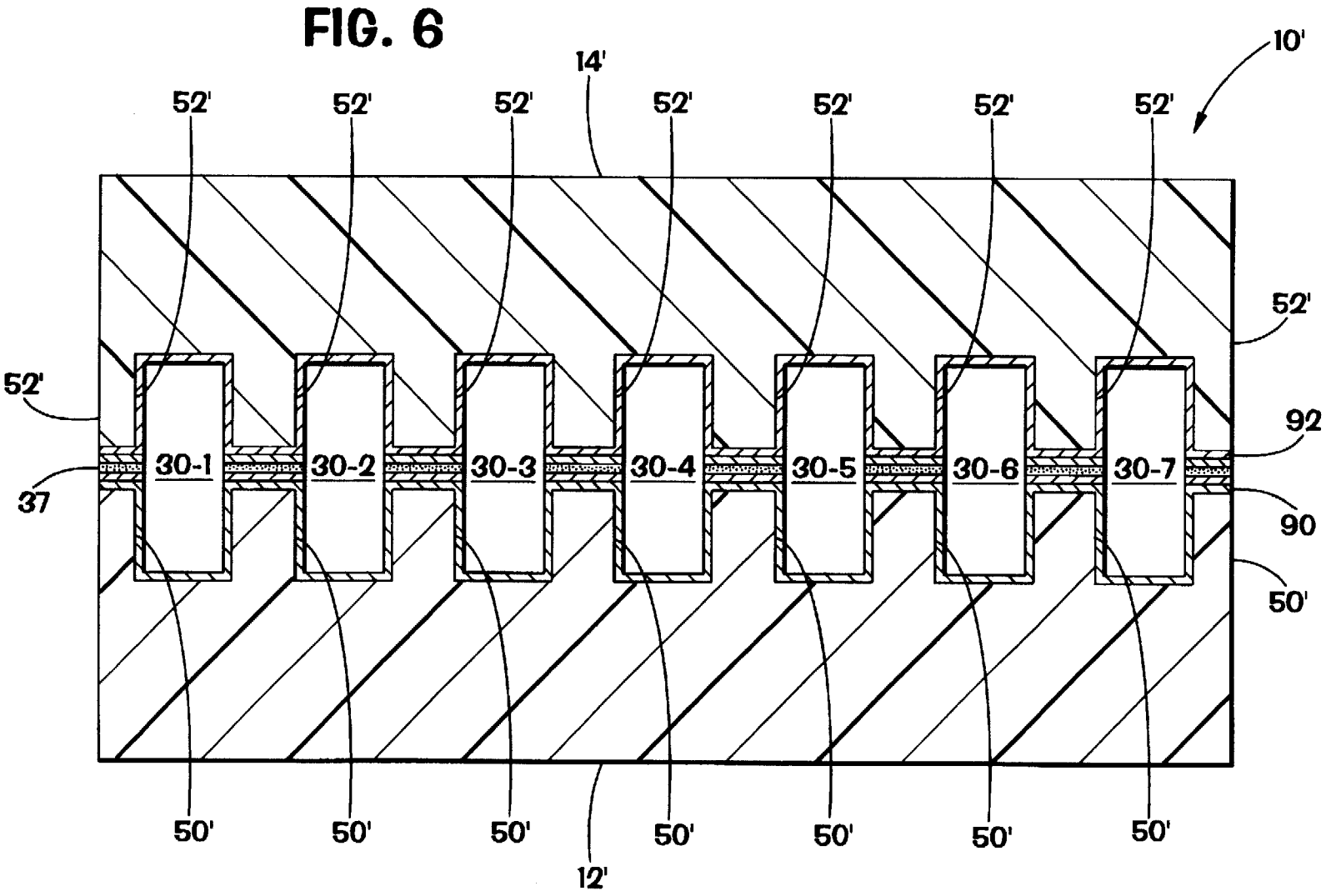
FIG. 6 is a cross-sectional front view of an alternate configuration of the page wide, circumferentially poled channel array of FIG. 2.

Referring next to FIG. 6, an alternate embodiment of the present invention will now be described in greater detail. In this embodiment of the invention, both the lower body part 12' and the upper body part 14' of the page wide channel array 10' are constructed of a compliant inactive material. After the lower and upper body parts 12' and 14' are grooved in the manner previously described to form a series of lower and upper body projections 50', 52', a layer of piezoelectric material 90, 92 is deposited on the upper and lower body parts 12', 14', respectively. A layer 37 of conductive adhesive is then used to conductively mount the projections 50', 52' to each other to form a series of channels 30-1 through 30-7. The layers 90, 92 of piezoelectric material are circumferentially poled and electrically connected to the controller 60. The layers 90 and 92 of piezoelectric material are selected such that the selective application of an electric field thereto will cause the layers 90 and 92 to undergo contour-extensional deformation and cause selected ones of the channels 30-1 through 30-7 to expand, thereby drawing ink from the ink delivery system, and compress, thereby ejecting droplets of ink therefrom.

The foregoing detailed description is to be clearly understood as being given by way of illustration and example only, the spirit and scope of the present invention being limited solely by the appended claims.

What is claimed is:

1. An ink jet print engine comprising:

a generally U-shaped lower body part having a top side surface having first and second projections, said lower body part being constructed of piezoelectric material circumferentially poled between said first and second projections of said top side surface;

a generally U-shaped upper body part having a bottom side surface having first and second projections conductively mounted to said first and second projections of said top side surface of said lower body part;

said generally U-shaped lower body part and said generally U-shaped upper body part defining an elongated liquid confining channel within said first and second projections of said top side surface and said first and second projections of said bottom side surface; and means for generating, between said first and second projections of said top side surface contour-extensional deformation of said circumferentially poled lower body part by producing a first electric field between said first and second projections of said top side surface.

2. An ink jet print engine according to claim 1 and further comprising means for generating, between said first and second projections of said bottom side surface, contour-extensional deformation of said circumferentially poled upper body part by producing a second electric field between said first and second projections of said bottom side surface.

3. An ink jet print engine according to clam 1 wherein said upper body part is constructed of piezoelectric material circumferentially poled between said first and second projections of said bottom side surface.

4. An ink jet print engine according to claim 3 and further comprising controller means for selectively applying a voltage differential between said first and second projections of said top side surface of said lower body part and between said first and second projections of said bottom side surface of said upper body part.

5. An ink jet print engine according to claim 4 and further comprising first and second strips of conductive material respectively formed on said first and second projections of said top side of said lower body part.

6. An ink jet print engine according to claim 5, wherein said upper body part has a first length and said lower body part has a second length, said second length being greater than said first length, said first and second strips of conductive material being exposed along a portion of said lower body part to provide electrical interconnection surfaces for said ink jet print engine.

7. A page wide ink jet print engine, comprising:

a lower body part formed from a piezoelectric material, said lower body part having a base section and a plurality of generally parallel spaced projections extending longitudinally along said base section and upwardly therefrom, each of said projections having a top side surface;

said lower body part circumferentially poled such that first and second polarization fields respectively extend between said top side surface of each one of said projections and top side surfaces of first and second projections adjacent thereto;

an upper body part formed from a piezoelectric material, said upper body part having a top section and a corresponding plurality of generally parallel spaced projections extending longitudinally along said top section and downwardly therefrom, each of said projections having a bottom side surface;

said upper body part circumferentially poled such that first and second polarization fields respectively extend between said top side surface of each one of said projections and top side surfaces of first and second projections adjacent thereto;

said top side surfaces of said lower body projections and said bottom side surfaces of said upper body projections conductively mounted together to define a plurality of generally parallel, axially extending ink-carrying channels from which ink may be ejected therefrom.

8. A page wide ink jet print engine according to claim 7 wherein each of said ink-carrying channels is defined by a pair of adjacent lower body projections, a segment of said bottom section between said pair of adjacent lower body projections, a corresponding pair of adjacent upper body projections and a segment of said top section between said pair of adjacent upper body projections.

9. A page wide ink jet print engine according to claim 7 and further comprising a conductive strip formed on said top side surface of each one of said lower body projections.

10. A page wide ink jet print engine according to claim 9 and further comprising a conductive strip formed on said bottom side surface of each one of said upper body projections.

11. A page wide ink jet print engine according to claim 10 and further comprising, for each one of said lower body projections, a layer of conductive adhesive for conductively mounting said conductive strip formed on said bottom side surface of said upper body projection with said conductive strip formed on said top side surface of said lower body projection.

12. A page wide ink jet print engine according to claim 9 and further comprising a controller having a control lead electrically to said conductive strip formed on said top side surface of each one of said lower body projections, said controller configured to selectively impart either a positive, a zero, or a negative voltage to said conductive strip.

13. A page wide ink jet print engine according to claim 9, wherein said upper body part has a first length and said lower body part has a second length, said second length being greater than said first length, said conductive strip formed on said top side surface of each one of said lower body projections being exposed along a portion of said lower body part to provide electrical interconnection surfaces for said ink jet print engine.

14. A page wide ink jet print engine, comprising:

a lower body part formed from a compliant inactive material, said lower body part having a base section with an upper side surface and a plurality of generally parallel spaced projections extending longitudinally along said base section and upwardly therefrom, each of said projections having top and sidewall surfaces;

a first layer of piezoelectric material formed on said upper side surface of said lower body part and said top and sidewall surfaces of each of said projections of said lower body part, said first layer of piezoelectric material circumferentially poled such that first and second polarization fields respectively extend between said piezoelectric material formed on said top side surface of each one of said projections and said piezoelectric material formed on top side surfaces of first and second projections adjacent thereto;

an upper body part formed from a compliant inactive, said upper body part having a top section with a lower side surface and a corresponding plurality of generally parallel spaced projections extending longitudinally along said top section and downwardly therefrom, each of said projections having bottom and sidewall surfaces;

a second layer of piezoelectric material formed on said lower side surface of said upper body part and said bottom and sidewall surfaces of each of said projections of said upper body part, said second layer of piezoelectric material circumferentially poled such that first and second polarization fields respectively extend between said piezoelectric material formed on said top side surface of each one of said projections and said piezoelectric material formed on top side surfaces of first and second projections adjacent thereto;

said piezoelectric material formed on said top side surfaces of said lower body projections and said piezoelectric material formed on said bottom side surfaces of said upper body projections conductively mounted together to define a plurality of generally parallel, axially extending ink-carrying channels from which ink may be ejected therefrom.

15. An ink jet print engine comprising:

a generally U-shaped lower body part having a top side surface with first and second projections;

a generally U-shaped upper body part having a bottom side surface with first and second projections conductively mounted to said first and second projections of said top side surface of said lower body part, said upper body part being constructed of piezoelectric material circumferentially polled between said first and second projections of said bottom side surface;

said generally U-shaped lower body part and said generally U-shaped upper body part defining an elongated liquid confining channel within said first and second projections of said top side surface and said first and second projections of said bottom side surface; and means for generating, between said first and second projections of said top side surface, contour-extensional deformation of said circumferentially poled upper body part by producing a first electric field between said first and second projections of said bottom side surface.

16. An ink jet print engine according to claim 15 and further comprising controller means for selectively applying a voltage differential between said first and second projections of said bottom side surface.

17. An ink jet print engine according to claim 16 and further comprising first and second strips of conductive material respectively formed on said first and second projections of said top said surface.

18. An ink jet print engine according to claim 17, wherein said upper body part has a first length and said lower body part has a second length, said second length being greater than said first length, said first and second strips of conductive material being exposed along a portion of said lower body part to provide electrical interconnection surfaces for said ink jet print engine.

* * * * *